US012097983B2

(12) United States Patent
Ceré et al.

(10) Patent No.: US 12,097,983 B2
(45) Date of Patent: Sep. 24, 2024

(54) APPARATUS AND METHOD FOR WRAPPING A LOAD

(71) Applicant: AETNA GROUP S.P.A., Verucchio (IT)

(72) Inventors: Mauro Ceré, Verucchio (IT); Massimiliano Vaccari, Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 0 days.

(21) Appl. No.: 18/018,927

(22) PCT Filed: Jul. 29, 2021

(86) PCT No.: PCT/IB2021/056904
§ 371 (c)(1),
(2) Date: Jan. 31, 2023

(87) PCT Pub. No.: WO2022/024020
PCT Pub. Date: Feb. 3, 2022

(65) Prior Publication Data

US 2023/0286684 A1 Sep. 14, 2023

(30) Foreign Application Priority Data

Jul. 31, 2020 (IT) ..... 102020000018874

(51) Int. Cl.
*B65B 41/16* (2006.01)
*B65B 11/02* (2006.01)
*B65B 11/00* (2006.01)

(52) U.S. Cl.
CPC ..... *B65B 11/025* (2013.01); *B65B 41/16* (2013.01); *B65B 2011/002* (2013.01)

(58) Field of Classification Search
USPC ..... 53/588
See application file for complete search history.

(56) References Cited

FOREIGN PATENT DOCUMENTS

| | | | | |
|---|---|---|---|---|
| EP | 0 466 980 | | 1/1992 | |
| IT | 201800010782 | A1 * | 6/2020 | ..... B65B 11/02 |
| WO | WO-2012001185 | A1 * | 1/2012 | ..... B29C 55/023 |
| WO | 2020/115643 | | 6/2020 | |

OTHER PUBLICATIONS

International Search Report issued Dec. 23, 2021, in International (PCT) Application No. PCT/IB2021/056904.

* cited by examiner

*Primary Examiner* — Chinyere J Rushing-Tucker
(74) *Attorney, Agent, or Firm* — Wenderoth, Lind & Ponack, L.L.P.

(57) ABSTRACT

An unwinding apparatus associable with a wrapping machine for delivering films comprises a supporting frame to rotatably support a first reel of a first film; adjustment elements to rotatably support a second reel of a second film and to arrange it in one of a plurality of operative positions, in which the second reel is staggered with respect to the first reel; guiding rollers to guide and partially overlap the first film and the second film at a longitudinal partial overlapping band; joining assembly for joining the first film and the second film along a longitudinal joining band made inside a width of the longitudinal partial overlapping band so as to obtain a single-body composite film; the joining assembly comprises a welding device or a gluing device.

15 Claims, 7 Drawing Sheets

Fig. 10
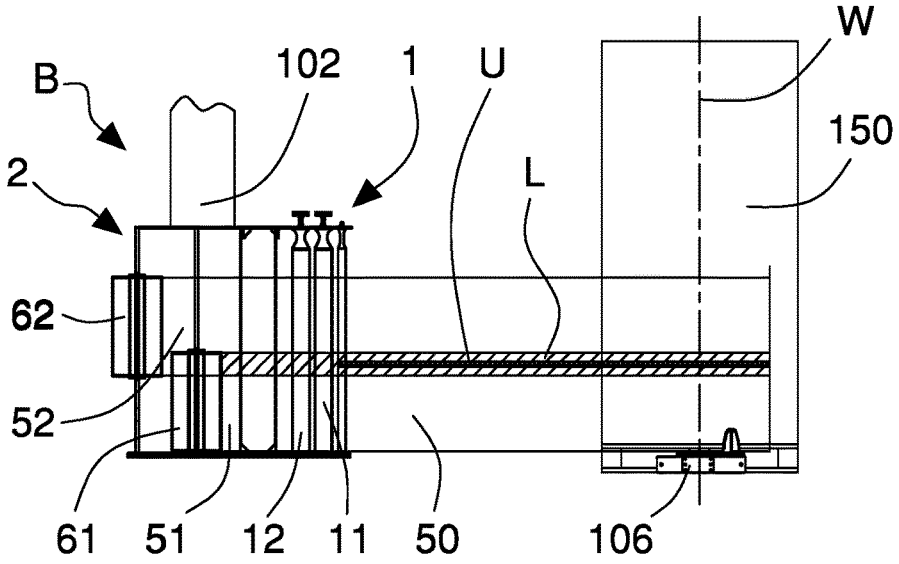
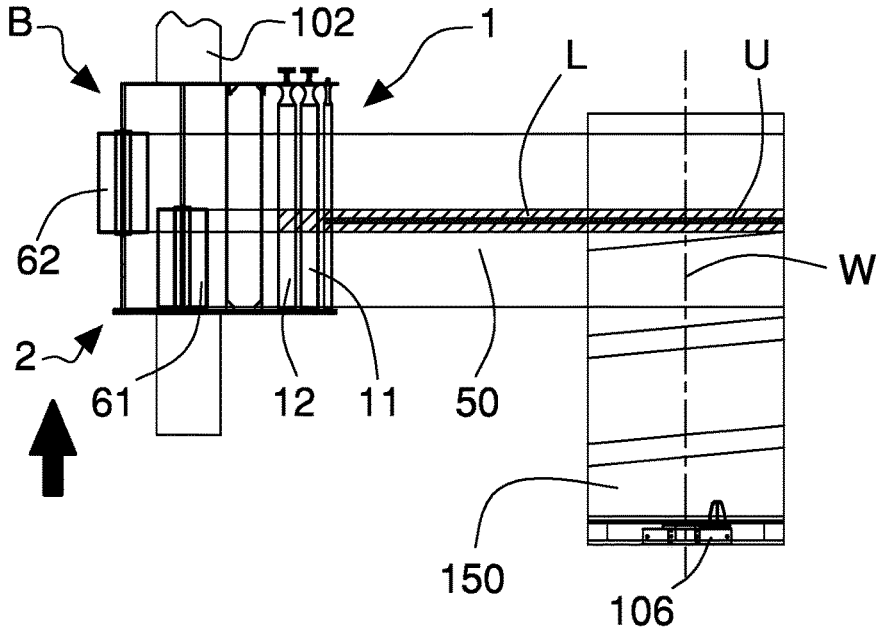
Fig. 11

APPARATUS AND METHOD FOR WRAPPING A LOAD

The invention relates to apparatuses and methods for wrapping a load with a film of cold extensible plastic.

It is known in the packaging industry to wrap a load formed by a single product or by a plurality of products grouped and arranged on a pallet with a film made of cold extensible plastic material.

In particular, the known wrapping machines comprise an unwinding apparatus which is movable along and/or about a wrapping axis and which supports a reel of film from which the film is unwound to be wrapped around the load so as to form a series of strips or bands generally having a helical pattern, due to the combination of the relative linear and rotational movements between the unwinding apparatus and the load.

In wrapping machines provided with a rotating table to support the load, during the wrapping cycle the latter is rotated about a vertical wrapping axis, while the unwinding apparatus is moved parallel to the wrapping axis with alternating motion along a fixed upright of the wrapping machine.

In wrapping machines with horizontal rotating ring or rotating arm, the load remains motionless during the wrapping, while the unwinding apparatus is moved with respect to the load both in rotation about a vertical wrapping axis and in translation along the latter. To this end, the unwinding apparatus is fixed to a ring structure or to an arm rotatably supported by a frame of the machine and so as to rotate around the load.

In wrapping machines with a vertical rotating ring the load is moved horizontally through the ring, while the unwinding apparatus fixed to the ring is rotated about a horizontal axis. The unwinding apparatus is generally provided with a pair of pre-stretching rollers, comprising a slow roller and a fast roller, respectively upstream and downstream with reference to the movement direction of the film, to stretch and unwind the film, and one or more guiding rollers to divert the film towards the load during the unwinding.

By suitably adjusting the difference between the rotation speeds of the two pre-stretching rollers, it is possible to stretch or extend by a defined amount, according to a set pre-stretch or extension percentage, the film exiting the unwinding apparatus before it is wrapped on the load.

In particular, the plastic film is stretched before being wrapped on the load since the stretching, or extension, allows the best use of the film and gives the film physical-mechanical features such as to make it more suitable to withstand the forces acting on the load during the subsequent handling and transport. Furthermore, when the stretching force ceases, the film springback causes a fastening force on the load which ensures its restrain. The stretching is generally expressed as a percentage of the ratio between the film extension (difference between the final length of the stretched film and the original length) and the original length. Typically the extension applied to the film is between 50 and 300%.

As is known, the stretching force or pre-stretching of the rollers allows to considerably reduce the thickness of the film (typically from about 25-20 μm to about 6-7 μm) so as to proportionately increase the length thereof in order to wrap a greater load perimeter with the same initial amount of unwound film.

The pre-stretching force exerted by the pre-stretching rollers also allows to change the mechanical characteristics of the film. The film material that is suitably stretched may change from an elastic type behaviour, in which the film tends to recover its original size upon cessation of the stress, to a substantially plastic type behaviour, in which the film undergoes a permanent deformation and does not fully recover its initial size upon cessation of the stress. In the latter case, the plastic film considerably reduces its springback capacity and behaves as a flexible and substantially inextensible element, similar to a rope or belt, and can be used, for example, to wrap groups of unstable products which must be held firmly together.

The pre-stretching force to which the film is subjected in order to obtain a set extension ratio or percentage depends on a number of factors: initial film thickness, physical-mechanical characteristics of the plastic material of the film (type of plastic material, composition, quantity and distribution of any internal impurities and unhomogeneities), environmental conditions (temperature, humidity) in which the load wrapping cycle is performed.

Although it is known that films of the same material and of the same nominal thickness belonging to different reels must be subjected to different pre-stretching forces to obtain similar extension ratios and above all to avoid an excessive thinning which would make the film unsuitable for a correct wrapping of the load and/or more prone to tears, ripping and breakages, notwithstanding tears, ripping and breakages occur frequently during the wrapping cycles.

In fact, variations in the physical-mechanical features of the film and, above all, in the thickness thereof can often also be found in the same film reel during the unwinding thereof. For example, depending on the production processes of the plastic film, generally linear low-density polyethylene, it is in fact possible to have films with different homogeneity and thickness uniformity. The thickness starting from a nominal value between 20-25 μm, may vary by ±10-20%.

Ambient conditions, in particular the temperature, also significantly affect the performance of the stretched film. More precisely, at lower temperatures the film extends and deforms with greater difficulty and, at the same pre-stretch ratio, can tear and break more easily and more frequently. Furthermore the temperature of the film depends also on the operating conditions, in particular it increases with the increase of the film wrapping speed and the stretching ratio.

Therefore there are a number of environmental and operational factors which cause excessive thinning, tears, ripping and even complete breakage of the film during the wrapping machines functioning, especially in the case of high stretching ratios. Such drawbacks result in incorrectly wrapped loads or, in the case of complete film breakage, in stops of the wrapping machine, and therefore of the production, in order to proceed with replacement of the film reel, as well as a waste of plastic material both in the case where the film is excessively thinned or torn and additional plastic film must be used to reinforce the thinning or tearing areas, and in the case where the film is broken, therefore unusable, and must be completely replaced.

Tears, ripping and breakages of the film also occur in the case of wrapping irregular loads, provided with edges, protruding and sharp portions and the like.

Regardless of the origin, localized tears and rips of the film can then propagate on the latter and lead to complete breakage of the film both during wrapping (typically in the case of high stretching ratios) and after wrapping, following the load handling and transport.

An object of the invention is to improve the known unwinding apparatus associable with wrapping machines and the known methods for wrapping a load with film made of extensible plastic material.

Another object is to provide an unwinding apparatus associable with a wrapping machine and a wrapping method which allow any type of load to be wrapped firmly and compactly, reducing and almost eliminating the risks of a complete breakage of the film during the wrapping.

A further object is to provide an unwinding apparatus and a wrapping method which allow high versatility and flexibility of the wrapping cycles and a reduction of the duration of said wrapping cycles.

Another further object is to provide an unwinding apparatus and a wrapping method which allows to optimize, in particular reduce, the amount of plastic material film used to wrap any type of load firmly and compactly.

In a first aspect of the invention, an unwinding apparatus is provided which can be associated with a wrapping machine according to claim 1.

In a second aspect of the invention, a method is provided for wrapping a load according to claim 9.

The invention can be better understood and implemented with reference to the attached drawings which illustrate exemplifying and non-limiting embodiments thereof, in which:

FIGS. 10 and 11 are schematic views illustrating a wrapping method performed by the unwinding apparatus and the wrapping machine of FIG. 1 in respective operating steps.

Figure 1:
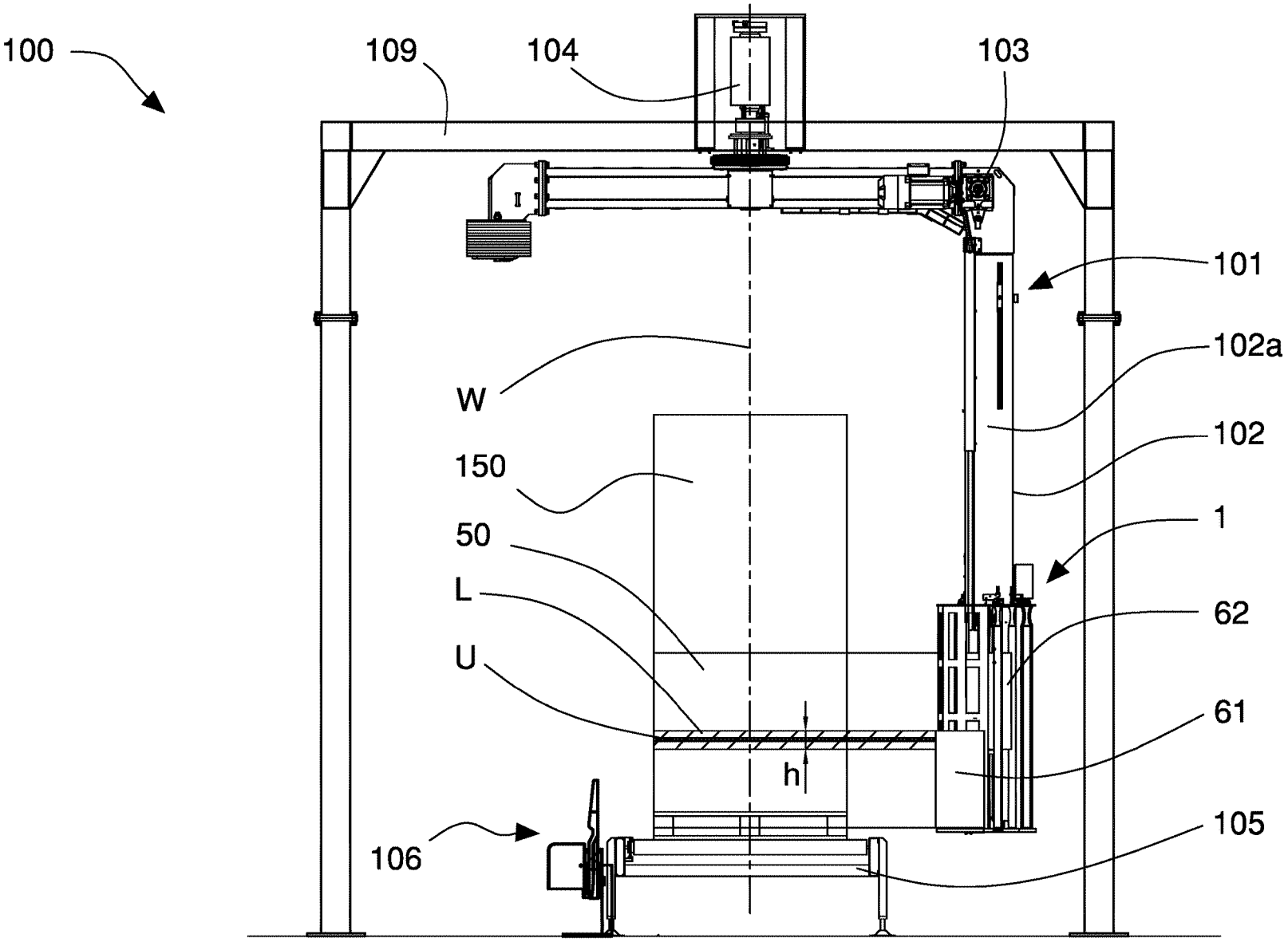
FIG. 1 is a side view of the film unwinding apparatus of the invention associated with a wrapping machine of the rotating arm type.
Figure 3:
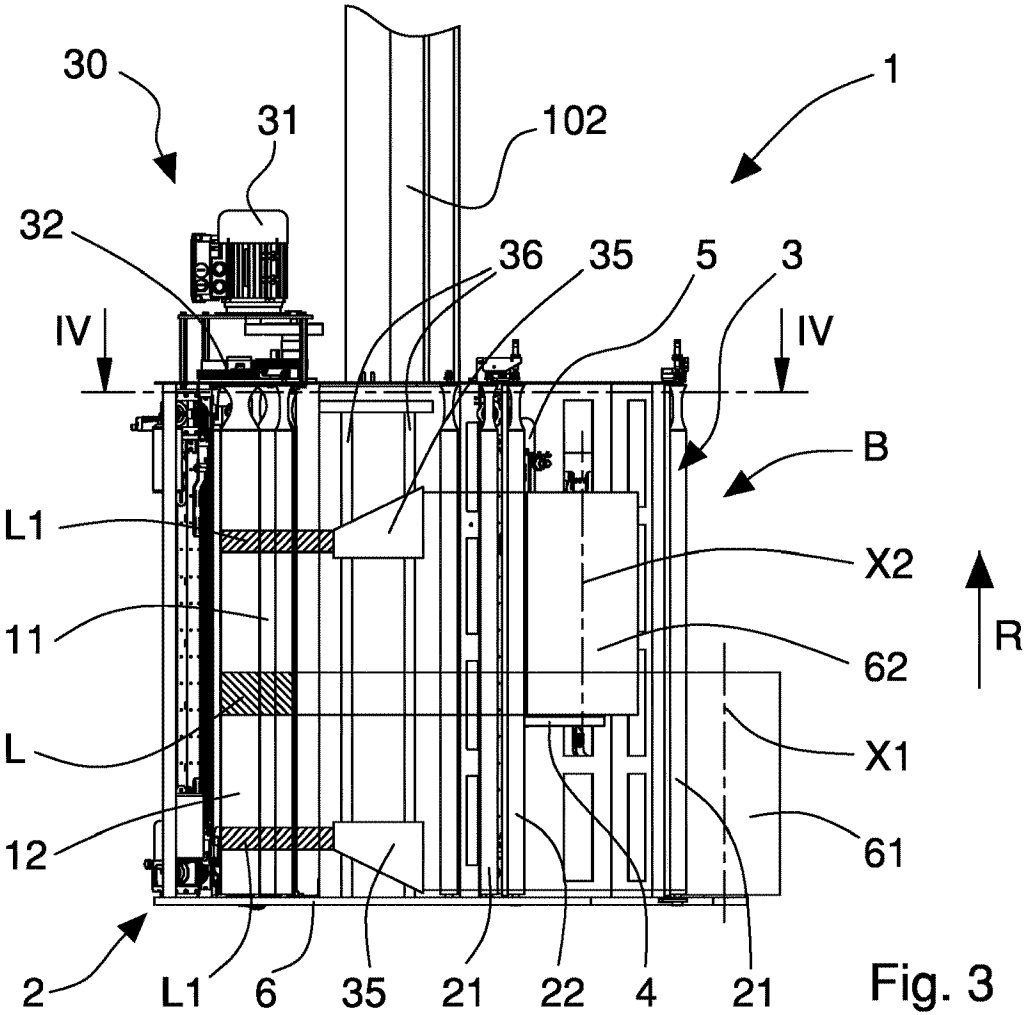
FIG. 3 is a front view of the unwinding apparatus of FIG. 2.
Figure 2:
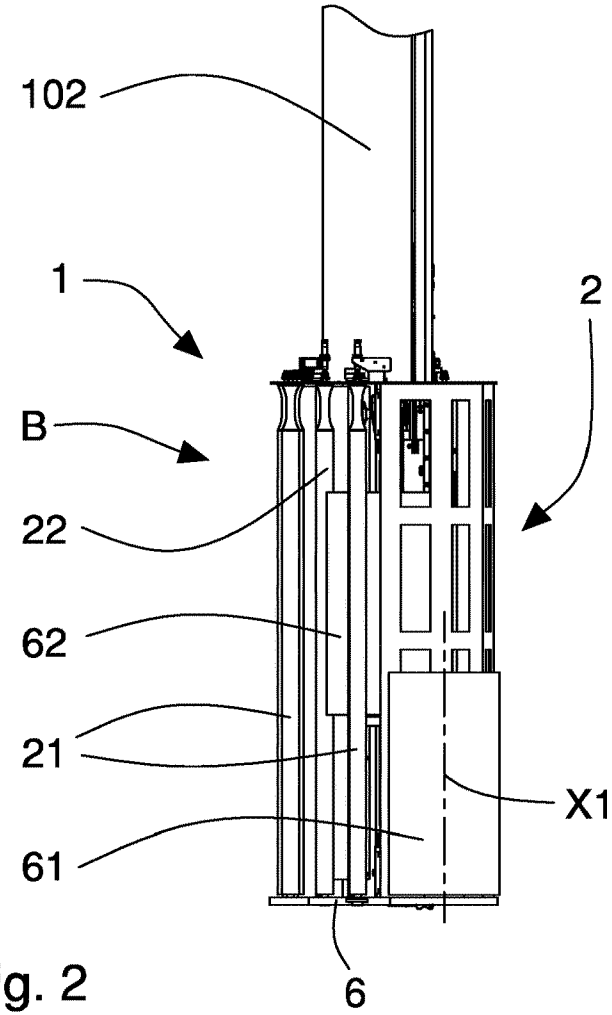
FIG. 2 is an enlarged side view of the unwinding apparatus of the invention.
Figure 4:
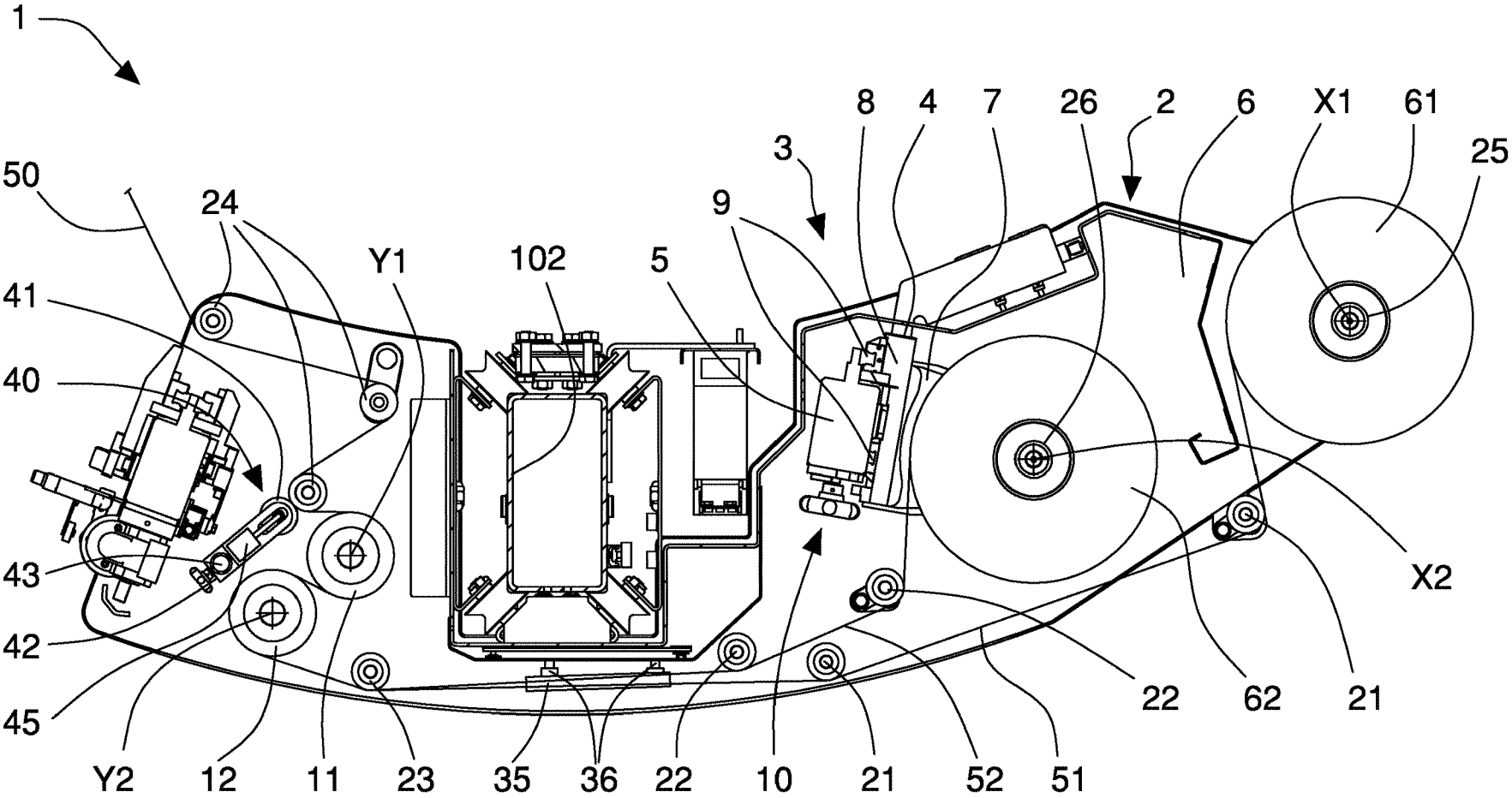
FIG. 4 is an enlarged cross section along the line IV-IV of FIG. 3.

With reference to FIGS. 1 to 6, the unwinding apparatus 1 of the invention associated with a wrapping machine 100 for wrapping cold extensible plastic films around a load 150 is illustrated, formed for example by one or more products grouped on a pallet.

The wrapping machine 100 is, for example, of the rotating arm type and provided with moving means 101 for moving the unwinding apparatus 1 parallel to a wrapping axis W, the apparatus arranged to deliver a first film 51 and at least one second film 52 both of extensible plastic material.

The unwinding apparatus 1 comprises a supporting frame 2 connected to the moving means 101 of the wrapping machine 100 and arranged to rotatably support a first reel 61 of a first film 51 about a first rotation axis X1.

The unwinding apparatus 1 further includes adjustment means 3 adapted to support at least one second reel 62 of a second film 52 rotatably about a respective second rotation axis X2 and arrange the second reel in one of a plurality of operative positions B, in which the second reel 62 is staggered with respect to the first reel 61 with reference to a supporting plane 6 of the supporting frame 2. Staggered means that the distance between a base, or lower plane side, of the second reel 62 and the supporting plane 6 is different, in particular greater, than the distance between the base of the first reel 61 and the supporting plane 6.

The adjustment means 3, during an adjusting step of the unwinding apparatus 1 that is performed with the wrapping machine 100 stopped, allow the second reel 62 to move with respect to the first reel 61 between the various operative positions B along an adjustment direction R parallel to the first rotation axis X1 and the second rotation axis X2. The first rotation axis X1 and the second rotation axis X2 of the two reels 61, 62 are almost orthogonal to the supporting plane 6 to which a first shaft 25 supporting the first reel 61 is rotatably fixed.

The second reel 62 can also be arranged in a further operative position (not shown), in which it is substantially aligned with the first reel 61 with reference to the supporting plane 6, i.e., is placed at the same distance from the supporting plane.

Preferably, the first reel 61 and the second reel 62 have the same height or length (intended as the transverse dimension, parallel to the rotation axis of the reel itself) i.e., the same band width of the respective films 51, 52.

The unwinding apparatus 1 also comprises guiding rollers 21, 22, 23 rotatably fixed to the supporting frame 2 and arranged to guide and partially overlap the first film 51 and the second film 52 at a longitudinal partial overlapping band L, in particular when the two films 51, 52 are unwound by the respective reels 61, 62, as better explained in the following description. The longitudinal partial overlapping band L, or overlapping band L for the sake of brevity, is parallel to an unwinding direction of the film 51, 52 from the rollers 21, 22, 23, and parallel to the longitudinal edges of the films 51, 52.

The unwinding apparatus 1 also includes joining means 40 configured to tightly join, and in particular irreversibly, the first film 51 and the second film 52 along a longitudinal joining band U made inside a width h of the overlapping band L (FIG. 1) so as to make a single-body composite film 50 formed by the first film 51 and the second film 52. More precisely, and as better explained in the following description, the joining means 40 join together the two films 51, 52 by welding or gluing during the unwinding thereof from the reels 61, 62 and make the longitudinal joining band U, or joining band U for brevity, which has a width smaller than or equal to the width h of the overlapping band L. The overlapping band in turn has a width smaller than a width of the first film 51 and/or of the second film 52.

The widths of the joining band U and the overlapping band L are understood as the linear dimensions of the bands which are parallel to the rotation axes X1, X2 of the reels 61, 62 of film.

The unwinding apparatus 1 further comprises a pair of pre-stretching rollers 11, 12 rotatably supported by the supporting frame 2 and configured to unwind and stretch the first film 51 and the second film 52 when they are already partially overlapped by the guiding rollers 21, 22, 23 along the overlapping band L during the wrapping cycle of the load 150.

The guiding rollers comprise one or more first guiding rollers 21, for example two, for guiding the first film 51 exiting the first reel 61, in particular towards the pre-stretching rollers 11, 12, and one or more second guiding rollers 22, for example two, for guiding the second film 52 exiting the second reel 62, in particular towards the pre-stretching rollers 11, 12. The guiding rollers also comprise a third guiding roller 23 arranged to overlap and guide, in particular towards the pre-stretching rollers 11, 12, the first film 51 and the second film 52 unwound by the respective reels 61, 62 and exiting the first and second guiding rollers 21, 22.

The unwinding apparatus 1 further comprises one or more return rollers 24, for example three, rotatably fixed to the supporting frame 2, in particular to the supporting plane 6, and arranged to guide the first film 51 and the second film 52 partially overlapped and tightly joined by the joining means 40 to form the composite film 50 exiting the unwinding apparatus 1 and towards the load 150 to be wrapped.

In the embodiment illustrated in FIGS. 1 to 6, the joining means 40 are arranged downstream of the pair of pre-stretching rollers 11, 12 with reference to an unwinding direction of the films 51, 52 so as to tightly join the first film 51 and the second film 52 already partially overlapped along the overlapping band L and stretched or extended together by the pre-stretching rollers 11, 12.

The joining means comprise welding means 40 of a known type, suitable for welding by fusion the plastic material, typically a low-density polyethylene, of the films 51, 52. In particular, the welding means comprise one or more of heating resistors, high-frequency generators, ultrasonic generators adapted to locally melt (along the joining band U) the plastic material of the films 51, 52.

Figure 5:
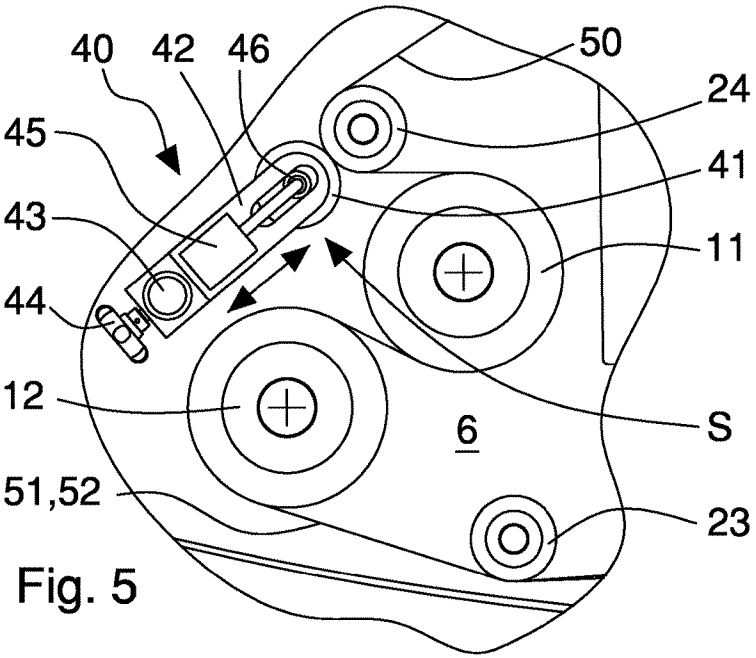
FIG. 5 is an enlarged detail of FIG. 4 illustrating in particular pre-stretching rollers and welding means.
Figure 6:
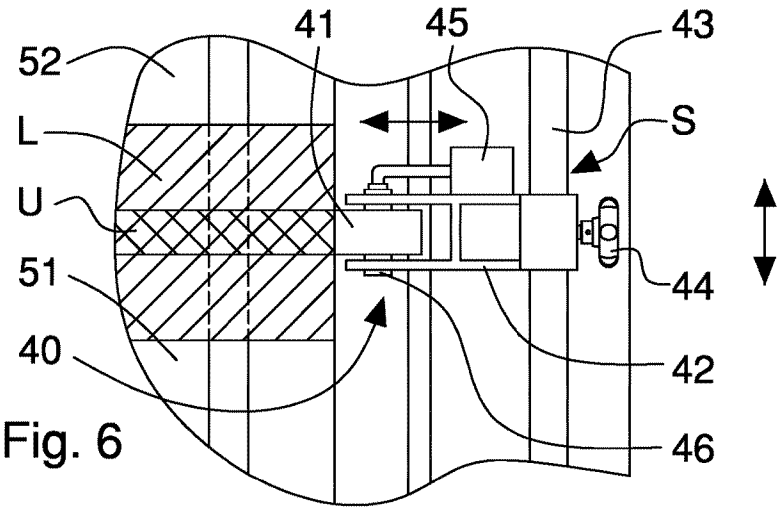
FIG. 6 is a rear partial view of the unwinding apparatus of FIG. 2 illustrating in particular the welding means.

With particular reference to FIGS. 5 and 6, the welding means 40 comprise, for example, a welding roller 41 heatable at a defined operating temperature and configured to abut and press the two films 51, 52 against an abutting roller consisting, for example, of one of the return rollers 24, at the overlapping band L so as to weld and join the two films tightly together along the joining band U.

The welding roller 41 is mounted free to rotate about a respective rotation axis parallel to the rotation axes of the return rollers 24 and the reels 61, 62 of film, on a supporting element 42 which is in turn slidably connected to a supporting rod 43 fixed to the supporting plane 6 of the supporting frame 2. The supporting element 42 can slide along the supporting rod 43 to allow the position of the welding roller 41 to be adjusted in height, with respect to the supporting plane 6 and the films 51, 52.

Blocking means 44 are provided for locking the supporting element 42 to the supporting rod 43 in a defined operative position, so as to prevent undesired displacements of the supporting element during operation. The stopping means comprise, for example, a respective locking screw 44 rotatably fixed to the supporting element 42 and acting on the supporting rod 43. The locking screw 44 is provided at one end with a knob by means of which it can be rotated by an operator to lock or unlock the supporting element 42.

The welding roller 41 is moved by a linear actuator 45 towards or away from the return roller 24, respectively between an operative position S, in which it presses and welds the two films 51, 52 against the abutting/return roller 24, and a rest position in which it is spaced from the abutting/return roller 24 and the films 51, 52. The linear actuator 45 is fixed to the supporting element 42 and is connected to a rotation pin 46 of the welding roller 41. The linear actuator 45 comprises, for example, an electromagnet, or a linear motor, or a pneumatic cylinder.

Alternatively, the welding roller can comprise a sonotrode of known type that transmits ultrasonic vibration, produced by an ultrasonic generator associated with a piezoelectric transducer and an amplification booster of the welding means, to the films 51, 52 to be welded.

The adjustment means 3 comprise a carriage 4 adapted to rotatably support the second reel 62 and a supporting column 5 fixed to the supporting frame 2 and arranged to slidably support the carriage 4 along the adjustment direction R so as to vary the position of the second reel 62 with respect to the first reel 61. More precisely, by moving the carriage 4 along the supporting column 5 it is possible to position the second reel 62 in one of the plurality of operative positions B, in which the second reel 62 is staggered with respect to the first reel 61 with reference to the supporting plane 6 so that in operation the second film 52 is unwound and overlapped on the first film 51 exiting the unwinding apparatus 1.

It should be noted that each of the plurality of operative positions B involves a respective width or height of the overlapping band L between the two films 51, 52, selectable according to the type of load and/or wrapping to be performed.

In the further operative position, in which the second reel 62 is substantially aligned with the first reel 61, the second film 52 is unwound and completely overlapped on the first film 51 and thus the width of the overlapping band L is equal to the height or width of the films 51, 52.

The carriage 4 is manually movable along the supporting column 5, in particular for adjusting the distance thereof from the supporting plane 6 of the supporting frame 2, and locking means 10 are provided for locking the aforementioned carriage 4 to the supporting column 5 in a defined operative position B, so as to prevent undesired displacements along the adjustment direction R, in particular during the operation of the wrapping machine, i.e., during the unwinding of the composite film 50. The locking means 10 comprise, for example, a respective locking screw rotatably fixed to the carriage 4 and acting on the supporting column 5. In particular, the locking screw is provided at one end with a knob by means of which it can be rotated by an operator to lock or unlock the carriage 4.

The carriage 4 comprises a platform 7 almost parallel to the supporting plane 6 and to which a second shaft 26 is rotatably fixed which supports the second reel 62. The carriage 4 also comprises a sliding portion 8 parallel to the supporting column 5 to which it is slidably connected by means of linear sliding guides 9 of known type and not described in detail.

In a version of the unwinding apparatus 1 of the invention that is not illustrated in the figures, the adjustment means 3 are arranged to support a plurality of second reels 62 of second films 52 and for this purpose comprise a plurality of carriages 4, each of which is arranged to rotatably support a respective second reel 62, and one or more supporting columns 5 fixed to the supporting frame 2 and arranged to slidably support the plurality of carriages 4 along the adjustment direction R. In this version of the unwinding apparatus 1 the pre-stretching rollers 11, 12 are arranged to extend or stretch a plurality of films 51, 52 after they have been partially overlapped, two by two, at a plurality of respective longitudinal partial overlapping bands L, in particular before entering the pre-stretching rollers 11, 12. The widths of the overlapping bands L can be the same or different, depending on the type of load and/or wrapping to be performed.

In this version of the unwinding apparatus 1, the welding means 40 comprise a plurality of welding rollers 41, connected through the respective supporting elements 42 to the supporting rod 43, so as to weld the plurality of films 51, 52 at the different overlapping bands L and create respective joining bands U so as to obtain a single single-body composite film 50 formed by the first film 51 and by the plurality of tightly joined second films 52.

First operating means 30 are provided for rotating the pre-stretching rollers 11, 12 about respective longitudinal rotation axes Y1, Y2, in particular with different rotation speeds. In the embodiment illustrated in the figures, the first operating means 30 comprise an electric motor 31 for rotating the first pre-stretching roller 11, or fast roller, and the second pre-stretching roller 12, or slow roller through transmission means 32. The transmission means 32 comprise, for example, a series of selectable and interchangeable toothed wheels so as to change the transmission ratio between the pre-stretching rollers 11, 12, i.e., to allow the electric motor 31 to rotate the second pre-stretching roller 12 at a respective speed lower than the speed of the first pre-stretching roller 11, in particular lower by a defined value so as to stretch or extend the films 51, 52 by a set amount or percentage.

The first pre-stretching roller 11 is positioned downstream of the second pre-stretching roller 12 with reference to the unwinding direction of the films 51, 51.

Alternatively, the first operating means 30 can comprise a pair of electric motors each of which acting on a respective pre-stretching roller 11, 12.

In the embodiment illustrated by way of non-limiting example, the unwinding apparatus 1 further comprises first folding means 35 positioned upstream of the pre-stretching rollers 11, 12, and the third guiding roller 23, with reference to the unwinding direction of the films 51, 52, and arranged to abut a longitudinal edge of the first film 51 and/or a longitudinal edge of the second film 52 and fold one or both of the films 51, 52 to obtain one or two longitudinal peripheral bands L1 of overlapping film.

The first folding means comprise, for example, a pair of shaped elements 35 arranged to abut and fold the respective films 51, 52. The shaped elements 35 are slidably fixed to a pair of guides 36, fixed to the supporting frame 2, so as to be movable parallel to the adjustment direction R to adjust a width of the longitudinal peripheral bands L1 of overlapping film.

In the embodiment shown in FIG. 1, the wrapping machine 100 is of the rotating arm type and the moving means 101 comprise arm means 102 rotatable about the wrapping axis W, substantially vertical, and provided with a supporting portion 102*a* almost parallel to the aforesaid wrapping axis W and adapted to slidably support the unwinding apparatus 1. The moving means 101 also include second operating means 103 arranged to linearly move the unwinding apparatus 1 along the supporting portion 102*a* of the arm means 102, i.e., parallel to the wrapping axis W.

The rotation axes X1, X2 of the two reels 61, 62 are almost parallel to the wrapping axis W. The arm means 102 are rotatably supported by a main frame 109 of the wrapping machine 100 and are rotated about the wrapping axis W by third operating means 104.

The wrapping machine 1 includes conveyor means 105 for supporting the load 150 to be wrapped and moving the load in and/or out of a work area.

The wrapping machine 100 also comprises gripping and cutting means 106 arranged adjacent to the conveyor means 105 in the work area for gripping the composite film 50 at the end of the wrapping cycle, cutting the film and retaining the end flaps of the films generated by the cutting so as to allow the wrapping of a subsequent load 150.

The operation of the unwinding apparatus 1 of the invention associated with the wrapping machine 100 includes an initial adjustment step in which, if necessary, the position of the second reel 62 is adjusted with respect to the first reel 61 as a function of the size and/or composition of the load 150 and/or the type of wrapping required. In particular, by acting on the adjustment means 3, the second reel 62 can be manually arranged in one of a plurality of operative positions B in which the reels 61, 62 are staggered with respect to the supporting plane 6 so that the two films 51, 52 can exit the unwinding apparatus 1 partially overlapped along the longitudinal partial overlapping band L whose width or height is a function of the position of the second reel 62.

Once the load 150 enters the work area through the conveyor means 105, the wrapping cycle can be activated and the two films 51, 52 are unwound by the respective reels 61, 62, overlapped at the third guiding roller 23 along the overlapping band L, stretched by the pre-stretching rollers 11, 12 with a defined extension percentage and tightly joined by the joining means 40 along the joining band U so as to obtain a single, single-body composite film 50, in particular formed by the first film 51 and the second film 52 firmly joined to each other.

The composite film 50 exiting the unwinding apparatus 1 is wrapped around the load 150 to form a series of bands or strips having a helical pattern due to the combination of the linear and rotational movements of the unwinding apparatus 1.

With reference to FIGS. 10 and 11, when the load 150 is formed by a plurality of regular products grouped in a substantially stable manner on a pallet, the two reels 61, 62 can be arranged staggered (with the second reel in an operative position B) so that the two films 51, 52 exit the unwinding apparatus 1 partially overlapped so as to increase the band width of the composite film 50 and reduce the number of rotation revolutions of the unwinding apparatus 1 around the load 150 that are needed to completely wrap the load and reduce the duration of the entire wrapping cycle.

Figure 7:
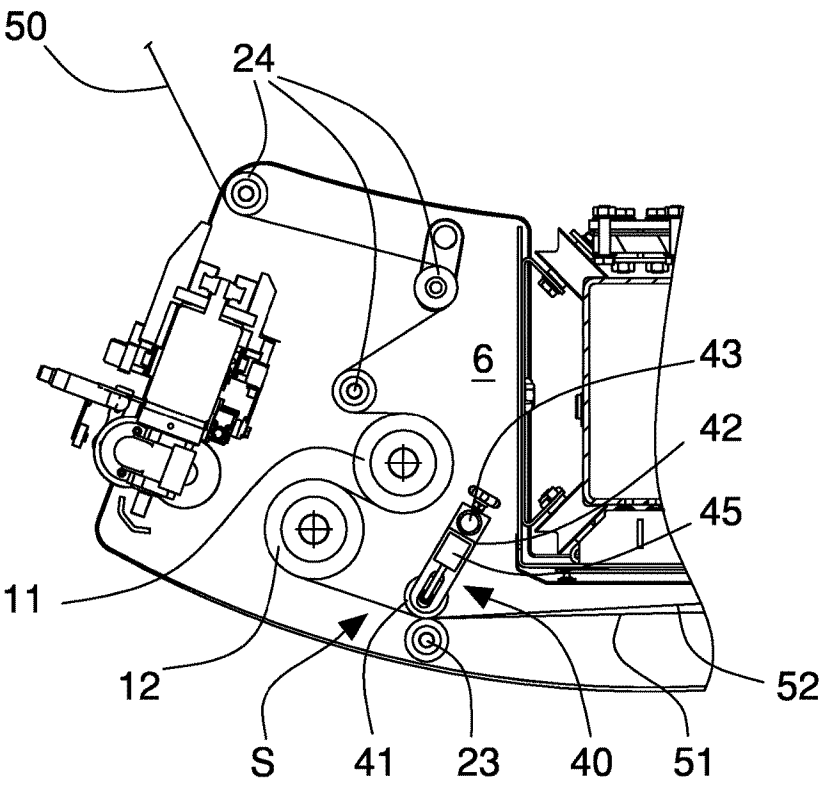
FIG. 7 is a section similar to that of FIG. 4, partial of a variant of the unwinding apparatus of the invention.

FIG. 7 illustrates a variant of the unwinding apparatus 1 of the invention that differs from the embodiment described above and illustrated in FIGS. 1 to 6 for the joining means 40 that are arranged upstream of the pair of pre-stretching rollers 11, 12, with reference to the unwinding direction of the films 51, 52, so as to closely join the first film 51 and the second film 52 when partially overlapped along the overlapping band L and before being stretched or extended.

More in detail, the joining means comprise the welding means 40 described above, fixed by means of the supporting rod 43 to the supporting plane 6 of the supporting frame 2 so that the welding roller 41 arranged in the operative position S by the linear actuator 45, abuts and presses the two films 51, 52 against the third guiding roller 23, acting as an abutting roller. In this configuration the two operations of partial overlapping and joining the two films 51, 52 occur simultaneously.

In another variant of the unwinding apparatus not illustrated, the welding means 40 comprise a separate abutting roller placed downstream of the third guiding roller 23, cooperating with the welding roller 41 to weld the two films.

Figure 8:
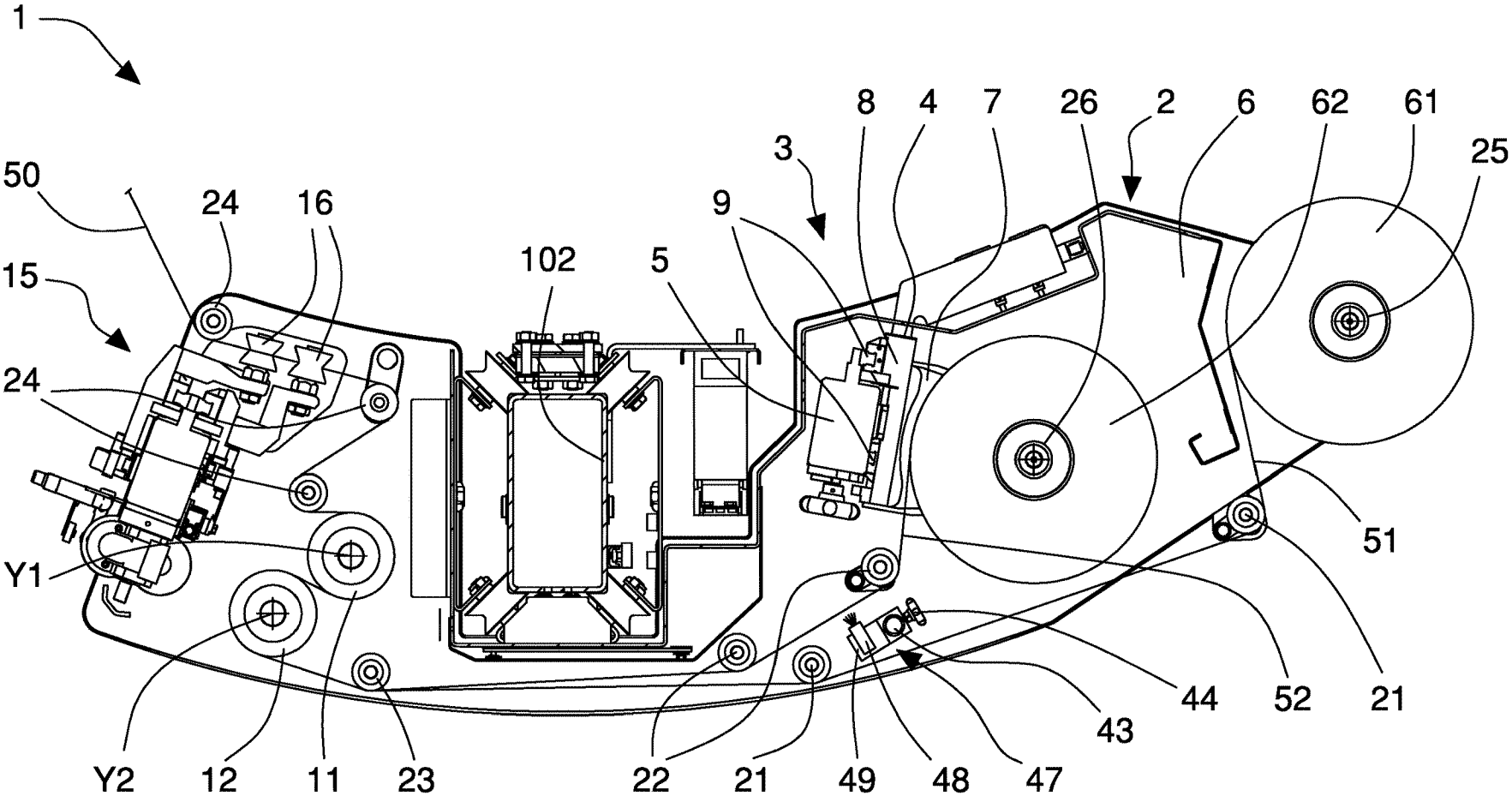
FIG. 8 is a section similar to that of FIG. 4, of another variant of the unwinding apparatus of the invention.

With reference to FIG. 8, another variant of the unwinding apparatus 1 of the invention is illustrated which differs from the embodiment described above and illustrated in FIGS. 1 to 6 in that the joining means comprise gluing means 47, 23 comprising a dispensing unit 47 adapted to spray or distribute a longitudinal strip of adhesive or glue on an inner face of one of the two films, for example the inner face of the second film 52 facing the inner face of the first film 51, and an adhesion roller, coinciding with the third guiding roller 23, to make the two films 51, 52 contact and adhere to each other.

The dispensing unit 47 of the gluing means is positioned on the supporting frame 2, interposed between the two films 51, 52 unwound by the respective reels 61, 62, before they are partially overlapped along the overlapping band L. In particular, in the example of FIG. 8, the dispensing unit 47 of the adhesive or glue is arranged upstream of the third guiding roller 23 which also acts as an adhesion roller on which they are wound, partially overlapping the two films 51 at the same time adhering or gluing to each other firmly along the strip of adhesive to form the longitudinal joining band U.

The dispensing unit 47 comprises a dispenser or sprayer 48 adapted to distribute a longitudinal strip of glue or adhesive on the inner face of the second film 52 so that the latter can adhere to the inner face of the first film 51 and tightly join the two films along the joining band U.

The dispensing unit 47 comprises a supporting element 49 on which the dispenser 48 is mounted and which is slidably connected to a supporting rod 43 fixed to the supporting plane 6 of the supporting frame 2. The supporting element 49 can slide along the supporting rod 43 to allow the position of the dispenser 48 to be adjusted in height, with respect to the supporting surface 6 and the films 51, 52. Stopping means 44 are provided for locking the supporting element 49 to the supporting rod 43 in a defined operative position, so as to prevent undesired displacements thereof during operation. The stopping means 44 comprise, for example, a locking screw with knob rotatably attached to the supporting element 49 and acting on the supporting rod 43.

The variant of the unwinding apparatus 1 of FIG. 8 also differs from the previously described embodiments in that it does not comprise the first folding means 35 placed upstream of the pre-stretching rollers 11, 12 and the third guiding roller 23, but second folding means 15 placed downstream of the pre-stretching rollers 11, 12 and arranged to abut and fold and/or roll one or both longitudinal edges of the composite film 50 and to make respective folded and/or pleated and/or rolled-up longitudinal reinforcement portions.

The second folding means 15, of known type and therefore not described in detail, comprise for example a pair of folding rollers 16 arranged to abut said opposite longitudinal edges of the 50*a*, 50*b* of the composite film 50.

Figure 9:
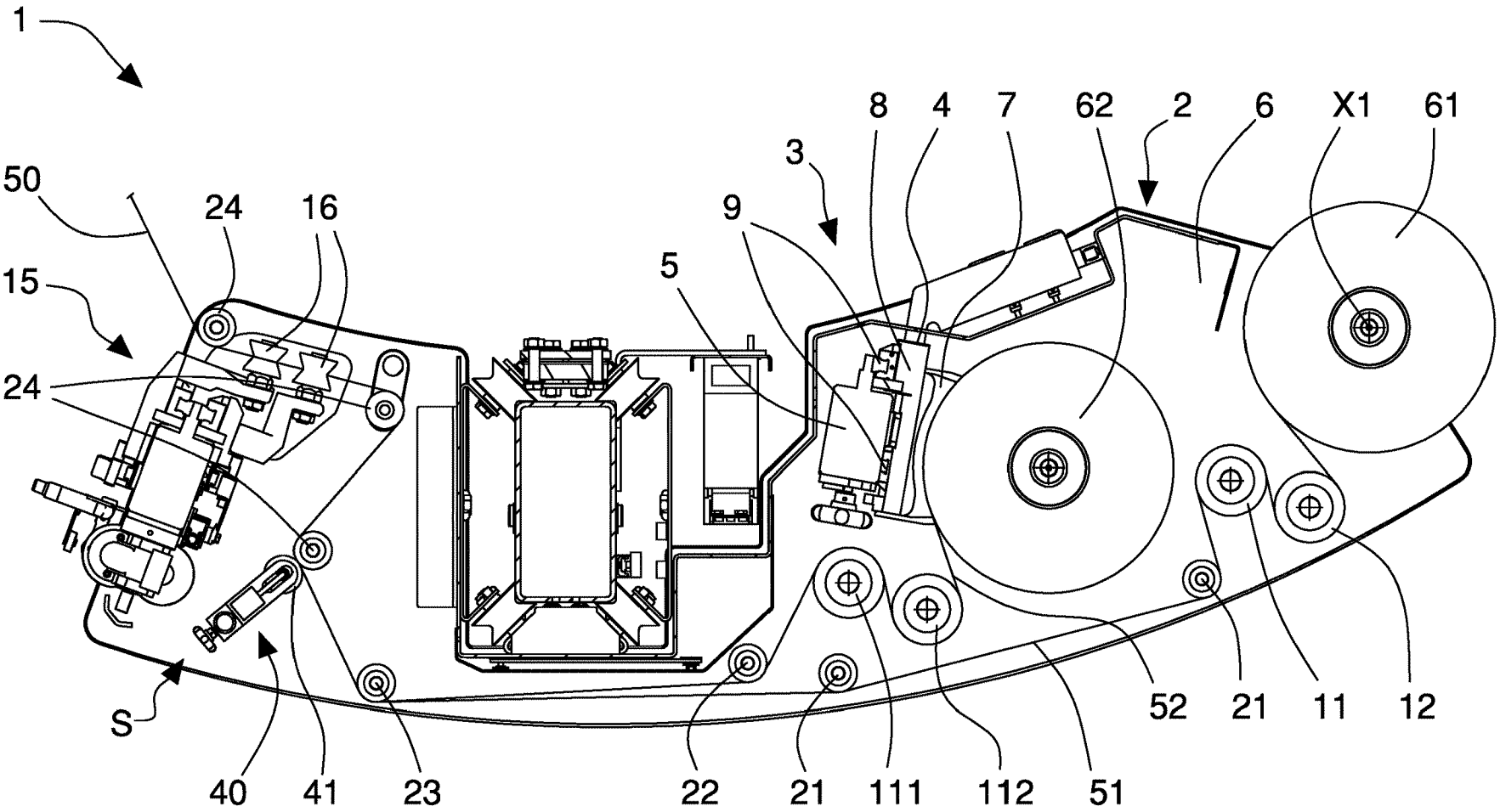
FIG. 9 is a section similar to that of FIG. 4, of a further variant of the unwinding apparatus of the invention.

With reference to FIG. 9, a further variant of the unwinding apparatus 1 of the invention is illustrated which differs from the embodiments described above in that it comprises a first pair of pre-stretching rollers 11, 12 rotatably supported by the supporting frame 2 and configured to unwind and stretch the first film 51 and a second pair of pre-stretching rollers 111, 112 rotatably supported by the supporting frame 2 and configured to unwind and stretch the second film 52. The guiding rollers 21, 22, 23 are arranged to guide and partially overlap the films 51, 52 exiting stretched or extended the respective pairs of pre-stretching rollers 11, 12, 111, 112. More precisely, the two stretched films 51, 52 are partially overlapping at the third return roller 23.

The welding means 40 are for example positioned on the supporting plane 6 of the supporting frame 2 downstream of the pre-stretching rollers 11, 12, 111, 112 and the third guiding roller 23 and are identical to those described for the embodiment of the unwinding apparatus of FIGS. 2-6. In particular, the welding means 40 comprise the welding roller 41 which in the operative position S abuts and presses the two films 51, 52 against an abutting roller coinciding with the first of the return rollers 24.

Alternatively, the welding means 40 can be positioned on the supporting plane 6 so that the welding roller 41 in the operative position S abuts and presses the two films 51, 52 against the third guiding roller 23 acting as the abutting roller.

It is also possible that the welding means 40 are replaced by the gluing means 47, 23 described above and comprising the dispensing unit 47, positioned on the supporting plane 2 interposed between the two films unwound from the respective reels 61, 62 before they are partially overlapped, and the adhesion roller consisting of the third guiding roller 23 around which the two films are wound.

The variant of the unwinding apparatus 1 of the invention illustrated in FIG. 8 further comprises, in place of the first folding means 35, the second folding means 15 placed downstream of the welding means 40 and the third guiding roller 23.

The method according to the invention for wrapping a load 150 with extensible plastic film comprises the following steps:

- unwinding a first film 51 from a first reel 61 and at least one second film 52 from a respective second reel 62;
- partially overlapping the first film 51 and the second film 52 so as to form a longitudinal partial overlapping band L;
- tightly joining the first film 51 and the second film 52 along a longitudinal joining band U made inside the longitudinal partial overlapping band L so as to obtain a single-body composite film 50 formed by the first film 51 and the second film 52;
- wrapping the load 150 with a plurality of bands or strips of the composite film 50;
- wherein said tightly joining, in particular in irreversible way, comprises welding, in particular by localized melting of the plastic material of the films 51, 52, or comprises adhering the films 51, 52 by glue or adhesive.

The method also includes, at the same time, partially overlapping and tightly joining the films.

Alternatively, after partially overlapping and before tightly joining the films, a pair of pre-stretching rollers 11, 12 of the unwinding apparatus is provided for stretching the first film 51 and the second film 52 partially overlapped along the longitudinal partial overlapping band L (or overlapping band L for brevity).

The method also includes, alternatively, before partially overlapping the films, stretching the first film 51 by means of a first pair of pre-stretching rollers 11, 12 of the unwinding apparatus 1 and stretching the second film 52 by means of a second pair of pre-stretching rollers 111, 112 of the unwinding apparatus 1.

The overlapping band L has a width h smaller than a width of the first film 51 and/or the second film 52; the longitudinal joining band U (or joining band for brevity) has a width smaller than or equal to the width h of the overlapping band L. The widths of the joining band U and the overlapping band L are understood as the linear dimensions of the bands that are parallel to the rotation axes X1, X2 of the reels 61, 62 of film.

According to the method of the invention, wrapping the composite film 50 around the load 150 comprises moving the reels 61, 62 and the load 150 with respect to each other parallely and about a wrapping axis W.

Optionally there is provided that at least one of the longitudinal edges of the films 51, 52 or of the composite film 50 is folded, pleated or rolled to form at least one longitudinal folded, pleated or rolled-up reinforcement portion.

Thanks to the unwinding apparatus and the wrapping method of the invention it is therefore possible to wrap a load 150 with a single-body composite film 50, formed by a first film 51 and by at least one second film 52 tightly and firmly joined to each other at a longitudinal joining band U, made inside a width h of the longitudinal partial overlapping band L formed by the two films 51, 52.

The width h of the overlapping band L can be selected according to the type of load and/or wrapping to be performed.

For this purpose, the unwinding apparatus 1 is provided with at least two reels 61, 62 of film 51, 52 and allows to arrange one of them, the second reel 62, in an operative position B in which it is staggered with respect to the other reel (the first reel 6) so that the two films 51, 52 exit the unwinding apparatus 1 partially overlapped at the overlapping band L.

The unwinding apparatus 1 further comprises joining means 40, 47, 23 configured to tightly join, in particular irreversibly, by welding or gluing the first film 51 and the second film 52 during the unwinding thereof from the reels 61, 62 so as to form the joining band U.

It should be noted that, being provided with an overlapping band L and above all a joining band U, the composite film 50 formed by the two partially overlapping films 51, 52 has a greater tensile strength than that of the individual films 50, 51, since the joining band U in particular acts as a reinforcement band.

It is therefore possible to considerably increase the mechanical resistance of the wrapping obtained on the load 150, with the same amount of film used, compared to traditional wrappings that provide the use of a single film or of two films applied separately from the respective unwinding apparatus (for example in the wrapping machines with two rotating arms), in such machines the overlapping of the film bands occurring directly on the load during the wrapping.

The wrapping that the unwinding apparatus 1 and the method of the invention allow to obtain is therefore firmer and tighter around the load 150, this ensuring a greater resistance to the infiltration of water and humidity and a correct tightening in all areas or portions of the load, even in those that do not offer a strong support to the film.

In order to increase the mechanical strength of the composite film 50, the film can also be provided with longitudinal folded, pleated, rolled reinforcement portions made by the folding means 35, 15 abutting the opposite longitudinal edges of the films 51, 52.

It has also been observed and verified by the applicant by means of numerous tests, that the joining band U also acts as a stopping band for the propagations of tears, rips, perforations that can occur due to various factors and causes during the wrapping cycle. More precisely, a tear or rip that is made on one of the films 51, 52, for example exiting the unwinding apparatus 1, can propagate towards the outer and free longitudinal edge of the film, but stops at the joining band U in which said film is tightly joined in a firm and stable way to the other film. Thereby, no complete breakage of one or both films can occur which can lead to the stop of the wrapping cycle or its completion using a single film.

It should be noted that a partial tear of one of the films (partial because it is stopped by the joining band U) does not compromise in any way the regular continuation of the wrapping cycle nor the effectiveness of wrapping the load 150, since the band of composite film 50 with such a partial tear maintains its mechanical features (tensile strength) substantially unchanged.

A greater resistance to tearing and ripping of the composite film 50 also in this case can be obtained by providing folded, pleated, rolled longitudinal reinforcement portions on the film made by the folding means 35, 15 abutting the opposite longitudinal edges of the films 51, 52.

It is also worth noting that thanks to the unwinding apparatus 1 of the invention it is possible to increase the band width of the composite film 50, i.e., of the two joined films that simultaneously wrap the load 150 so as to reduce a duration of the wrapping cycle and increase the productivity of the wrapping machine 100.

More precisely, by increasing the band width of the two overlapping films 51, 52, i.e., of the composite film 50, fewer rotation revolutions of the unwinding apparatus 1 around the load 150 are necessary in order to completely wrap the load. Thereby, it is possible to reduce the duration of the wrapping cycle and increase the productivity of the wrapping machine 100.

It is also possible to wrap a load 150 of limited size with a series of overlapping bands of composite film 50 without a helical pattern, i.e., without moving the unwinding apparatus 1 linearly along the wrapping axis W, by arranging the second reel 62 in a respective operative position B in which the width or band width of the composite film 50 thus made is equal to the height of the load 150.

This wrapping, in addition to requiring a shorter run time, is more firm and strong.

It should be noted, finally, by forming a single-body composite film 50 it is not necessary, in a terminal step of the wrapping cycle, that the gripping and cutting means 106 of the wrapping machine 100 grasp and hold both films 51, 52, but it is sufficient that they tighten only a portion of the composite film 50 since the two films 51, 52 are closely joined to each other at least at the joining band U. Thereby, the same gripping and cutting means 106 used to operate on a single film can be used regardless of the extent of the overlap.

The unwinding apparatus 1 of the invention mounted on a wrapping machine 100 of the invention therefore allows to achieve a high versatility and flexibility in the wrapping processes.

At the same time, the unwinding apparatus 1, in addition to being particularly compact and functional, has a very reliable and precise functioning.

The invention claimed is:

1. An unwinding apparatus associable with a wrapping machine for delivering films made of extensible plastic material, the unwinding apparatus comprising:

a supporting frame arranged to rotatably support a first reel of a first film about a first rotation axis;

an adjustment assembly fixed to said supporting frame and configured to rotatably support at least one second reel of a second film about a second rotation axis and to arrange the at least one second reel in one of a plurality of operative positions, in which the at least one second reel is staggered with respect to the first reel with reference to a supporting plane of said supporting frame;

guiding rollers rotatably supported by said supporting frame and arranged to guide and partially overlap the first film and the at least one second film at a longitudinal partial overlapping band; and a joining assembly for tightly joining the first film and the at least one second film along a longitudinal joining band made inside a width of the longitudinal partial overlapping band so as to obtain a single-body composite film formed by the first film and the at least one second film, wherein said joining assembly comprises a welding device for joining by localized melting of the plastic material of the first film and the at least one second film, or a gluing device for joining the first film and the at least one second film by adhesion by means of glue or adhesive.

2. The unwinding apparatus according to claim 1, further comprising a pair of pre-stretching rollers rotatably supported by said supporting frame and configured to unwind and stretch the first film and the at least one second film partially overlapped by said guiding rollers along the longitudinal partial overlapping band.

3. The unwinding apparatus according to claim 1, further comprising a first pair of pre-stretching rollers rotatably supported by said supporting frame and configured to unwind and stretch the first film and a second pair of pre-stretching rollers rotatably supported by said supporting frame and configured to unwind and stretch the at least one second film, said guiding rollers being arranged for guiding and partially overlapping the stretched first film and the stretched at least one second film exiting said pairs of pre-stretching rollers.

4. The unwinding apparatus according to claim 3, wherein said joining assembly is positioned downstream of said pairs of pre-stretching rollers with reference to an unwinding direction of the first film and the at least one second film in order to tightly join the first film and the at least one second film separately stretched by said pairs of pre-stretching rollers.

5. The unwinding apparatus according to claim 1, wherein said welding device comprises one or more of heating resistors, high-frequency generators, ultrasonic generators adapted to locally melt the plastic material of the first film and the at least one second film.

6. The unwinding apparatus according to claim 1, wherein said welding device comprises a welding roller.

7. The unwinding apparatus according to claim 6, wherein said welding roller is heatable at a defined operating temperature or adapted to generate vibrations with ultrasonic frequency, configured to abut and press the first film and the at least one second film against an abutting roller at the longitudinal partial overlapping band so as to weld the first film and the at least one second film together along the longitudinal joining band.

8. The unwinding apparatus according to claim 1, wherein said gluing device comprises a delivering unit adapted to spread a strip of adhesive on an internal face of one of the first film or the at least one second film and an adhesion roller around which the first film and the at least one second film are wound, partially overlapping each other and firmly adhering to each other along the strip of adhesive so as to form the longitudinal joining band.

9. The unwinding apparatus according to claim 1, wherein said guiding rollers comprise at least one first guiding roller for guiding the first film exiting the first reel, at least one second guiding roller for guiding the at least one second film exiting the at least one second reel, and at least one third guiding roller for guiding and partially overlapping the first film and the at least one second film.

10. A wrapping machine comprising moving means for moving an unwinding apparatus according to claim 1 about and/or parallel to a wrapping axis.

11. A method for wrapping a load with films of extensible stretchable plastic material, the method comprising:

unwinding a first film from a first reel and at least one second film from a respective second reel;

partially overlapping the first film and the at least one second film so as to form a longitudinal partial overlapping band;

tightly joining the first film and the at least one second film along a longitudinal joining band made inside the longitudinal partial overlapping band so as to obtain a single-body composite film formed by the first film and by the at least one second film; and wrapping the load with a plurality of bands of the single-body composite film, wherein said tightly joining comprises welding by localized melting of the plastic material of the first film and the at least one second film, or comprises making the first film and the at least one second film adhere by means of glue or adhesive.

12. The method according to claim 11, further comprising simultaneously partially overlapping and tightly joining the first film and the at least one second film.

13. The method according to claim 11, further comprising after said partially overlapping and before said tightly joining, stretching by means of a pair of pre-stretching rollers the first film and the at least one second film which are partially overlapped along the longitudinal partial overlapping band.

14. The method according to claim 11, further comprising, before said partially overlapping, stretching by means of a first pair of pre-stretching rollers the first film and by means of a second pair of pre-stretching rollers the at least one second film.

15. The method according to claim 11, wherein the longitudinal partial overlapping band has a width which is smaller than a width of the first film and/or the at least one second film and the longitudinal joining band has a width which is smaller than or equal to the width of the longitudinal partial overlapping band.

* * * * *